United States Patent [19]

Sugimoto et al.

[11] Patent Number: 4,656,120

[45] Date of Patent: Apr. 7, 1987

[54] SILVER HALIDE PHOTOGRAPHIC LIGHT-SENSITIVE MATERIALS

[75] Inventors: Tadao Sugimoto; Hideo Ikeda, both of Kanagawa, Japan

[73] Assignee: Fuji Photo Film Co., Ltd., Japan

[21] Appl. No.: 894,701

[22] Filed: Aug. 5, 1986

Related U.S. Application Data

[63] Continuation of Ser. No. 564,647, Dec. 22, 1983, abandoned.

[30] Foreign Application Priority Data

Dec. 27, 1982 [JP] Japan ..... 57-234652

[51] Int. Cl.[4] ..... G03C 1/02

[52] U.S. Cl. ..... 430/434; 430/523; 430/567

[58] Field of Search ..... 430/567, 523, 502, 434

[56] References Cited

U.S. PATENT DOCUMENTS

| | | | |
|---|---|---|---|
| 2,996,382 | 8/1961 | Luckey et al. | 430/502 |
| 3,178,282 | 4/1965 | Luckey et al. | 430/502 |
| 3,397,987 | 8/1968 | Luckey et al. | 430/603 |
| 3,607,278 | 9/1971 | Ditzer et al. | 430/567 |
| 3,695,881 | 10/1972 | Luckey | 430/502 |
| 4,400,463 | 8/1983 | Naskasky | 430/615 |
| 4,433,048 | 2/1984 | Solberg et al. | 430/434 |
| 4,435,500 | 3/1984 | Okutsu et al. | 430/419 |
| 4,444,865 | 4/1984 | Silverman et al. | 430/503 |
| 4,444,874 | 4/1984 | Silverman et al. | 430/410 |
| 4,459,351 | 7/1984 | Adini et al. | 430/223 |

OTHER PUBLICATIONS

*Research Disclosure* 17643, Dec. 1978.

*Primary Examiner*—Won H. Louie

*Attorney, Agent, or Firm*—Sughrue, Mion, Zinn, Macpeak, and Seas

[57] ABSTRACT

A silver halide photographic light-sensitive material is disclosed. The material is comprised of a support having provided thereon at least one silver halide emulsion layer which is coated with a surface protective layer. The silver halide emulsion layer includes an inside fogged silver halide emulsion and a light-sensitive silver halide emulsion containing silver halide grains which are tabular silver halide grains having a grain diameter which is 5 times or more the grain thickness. The material is highly sensitive and forms images which have high contrast and a high maximum density. The material can be developed in a relatively short developing time at a low temperature treatment without using additives.

18 Claims, No Drawings

SILVER HALIDE PHOTOGRAPHIC LIGHT-SENSITIVE MATERIALS

This is a continuation of application Ser. No. 564,647, filed Dec. 22, 1983, now abandoned.

FIELD OF THE INVENTION

The present invention relates to silver halide photographic light-sensitive materials and, in greater detail, to silver halide photographic light-sensitive materials which have high sensitivity and which form images having a high contrast and a high maximum density.

BACKGROUND OF THE INVENTION

With respect to photographic images composed of silver, the ratio of optical density of images to the amount of silver composing the images per unit area is generally called covering power, which is a measure for valuation of optical efficiency of silver composing the images. The covering power of the silver halide photographic light-sensitive layer increases generally with reduction of the grain size of silver halide grains and decreases as the grain size increases. On the other hand, since the sensitivity of the silver halide emulsion layer generally becomes high with the increase of the grain size of silver halide grains, silver halide emulsions having a large grain size are used for producing photographic light-sensitive materials having a high sensitivity. Accordingly, the photographic light-sensitive materials having a high sensitivity require a large amount of silver per unit area in order to obtain a certain image density. In other words, it is needed for the material to contain a larger amount of silver salts per unit area of the photographic light-sensitive material in order to obtain both the high sensitivity and the required maximum image density. This is the actual state that the prior photographic light-sensitive materials having a high sensitivity are encountered.

One attempt at improving the covering power while maintaining high sensitivity involves adding various polymers to a high-speed coarse silver halide emulsion. Such techniques have been described in British Pat. Nos. 1,048,057 and 1,039,471 and U.S. Pat. Nos. 3,043,697 and 3,446,618. They are all insufficient, because though the covering power is improved more or less, the strength of the coating film deteriorates. Particularly, in an automatic developing machine which is now conventionally used, when a photographic material having a coating film of poor strength is used, part of the gelatin in the film dissolves in a developing solution or a fixing solution and adheres to conveying rolls in the automatic developing machine. Accordingly, pollution of photographic images is caused by transferring to the light-sensitive material.

On the other hand, U.S. Pat. Nos. 2,996,382 and 3,178,282 have disclosed that photographic images having a high contrast and a high covering power are obtained at high sensitivity using silver halide photographic light-sensitive materials wherein surface latent image type coarse silver halide grains and fine silver halide grains having fog nuclei in the inside thereof are contained in the same layer or in adjacent layers.

However, this method is not desirable because development requires a long period of time in conventional low temperature treatment in order to obtain a sufficiently high density and a high contrast at high sensitivity, and the desired effect cannot be obtained with conventional high temperature rapid treatment.

Attempts at eliminating these disadvantages involve introducing various additives such as rhodan, imidazoles, thioethers, etc. into light-sensitive materials or processing solutions. (For example, U.S. Pat. No. 2,996,382 and Japanese Patent Application (OPI) Nos. 78535/82 and 89749/82. The term "OPI" as used herein refers to a "published unexamined Japanese patent application".) However, it is obvious that any means for improving the above described disadvantages without adding the additives is more preferred.

SUMMARY OF THE INVENTION

Accordingly, an object of the present invention is to provide silver halide photographic light-sensitive materials which have a high sensitivity and which form images having a high contrast and a high maximum density.

Another object of the present invention is to shorten the developing time in the low temperature treatment without using additives and to give a property capable of carrying out the high temperature rapid treatment.

As a result of earnest studies in order to attain the above described objects, the present inventors have found that they can be attained by providing the following photographic light-sensitive materials.

Namely, it has been found that they can be attained by providing silver halide photographic light-sensitive materials comprising a support having provided thereon at least one silver halide emulsion layer and a surface protective layer covering the silver halide emulsion layer, wherein the silver halide photographic light-sensitive materials contain a light-sensitive silver halide emulsion and an inside fogged silver halide emulsion, and silver halide grains contained in the light-sensitive silver halide emulsion are tabular silver halide grains having a diameter of 5 times or more of the thickness thereof.

DETAILED DESCRIPTION OF THE INVENTION

The term "light-sensitive" in the present invention means that the sensitivity of the light-sensitive silver halide emulsion is higher than that of the inside fogged silver halide emulsion. In greater detail, it means that the light-sensitive silver halide emulsion has a sensitivity of 10 or more times higher, preferably 100 or more times higher, than the sensitivity of the inside fogged silver halide emulsion.

Sensitivity used here is defined similarly to the sensitivity as described later.

As the light-sensitive silver halide emulsions, conventional silver halide emulsions such as a surface latent image type emulsions, etc. are used.

The surface latent image type silver halide emulsion used here means an emulsion wherein the sensitivity obtained by surface development (A) is larger than the sensitivity obtained by internal development (B) and, preferably, the sensitivity of the former is two or more times higher than that of the latter, when the emulsion is developed by the surface development (A) and the internal development (B) after exposed to light for 1 to 1/100 second. The sensitivity used here is defined as follows:

$$S=100/Eh$$

wherein S represents sensitivity, and Eh represents exposed amount necessary to obtain the middle density of maximum density (Dmax) and minimum density (Dmin): $\frac{1}{2}$(Dmax+Dmin).

[Surface development (A)]

Development is carried out in a developing solution having the following formulation at 20° C. for 10 minutes.

| | |
|---|---|
| N—Methyl-p-aminophenol (hemisulfate) | 2.5 g |
| Ascorbic acid | 10 g |
| Sodium metaborate tetrahydrate | 35 g |
| Potassium bromide | 1 g |
| Water to make | 1 l |

[Internal development (B)]

After the light-sensitive material is treated in a bleaching solution containing potassium ferricyanide 3 g/l and phenosafranine 0.0126 g/l at about 20° C. for 10 minutes and washed with water for 10 minutes, it is developed in a developing solution having the following formulation at 20° C. for 10 minutes.

| | |
|---|---|
| N—Methyl-p-aminophenol (hemisulfate) | 2.5 g |
| Ascorbic acid | 10 g |
| Sodium metaborate tetrahydrate | 35 g |
| Potassium bromide | 1 g |
| Sodium thiosulfate | 3 g |
| Water to make | 1 l |

As the light-sensitive silver halide emulsion in the present invention, silver halide emulsions containing tabular silver halide grains are used. As silver halide grains contained in the light-sensitive emulsion, tabular silver halide grains are used, but the ratio of the tabular silver halide grains used is preferred to be 10% by weight or more, preferably 50° C. by weight or more, based on the weight of all the silver halide grains.

In the following, the tabular silver halide grains used in the present invention is described.

The tabular silver halide grains in the present invention have a diameter/thickness ratio of 5 or more, preferably 5 to 100, more preferably 5 to 50, and particularly 7 to 20.

The diameter of the tabular silver halide grains used here means the diameter of a circle having the same area as the projected area of the grain. In the present invention, the diameter of the tabular silver halide grains is preferred to be in a range of 0.5 to 10 μm, more preferably 0.5 to 5.0 μm, and particularly preferably 1.0 to 4.0 μm.

Generally, the tabular silver halide grains are plates having two parallel faces. Accordingly, the term "thickness" in the present invention means the distance between two parallel faces composing the tabular silver halide grain.

The tabular silver halide grains are preferred to have a halogen composition of silver bromide or silver iodobromide, and preferably silver iodobromide having a silver iodide content of 0 to 10% by mol.

In the following, the process for producing the tabular silver halide grains is described.

The tabular silver halide grains can be produced by suitably combining methods known in this field.

For example, they are obtained by a process which comprises forming seed crystals in which tabular grains are present in an amount of 40% by weight or more, in an atmosphere of pBr 1.3 or less and a comparatively high pAg value, and adding a silver salt solution and a halide solution at the same time with keeping the pBr value at the above described value to grow the seed crystals.

It is preferred to add the silver salt solution and the halide solution so as not to generate fresh crystal nuclei in the process of growing grains.

The size of the tabular silver halide grains can be controlled by control of temperature, selection of the solvent or amount thereof, and control of rates of adding silver salts and halides used for growing grains.

In production of the tabular silver halide grains of the present invention, if desired, a silver halide solvent can be used, by which it is possible to control grain size, shape of grains (ratio of diameter/thickness, etc.), distribution of grain size and rate of growth of grains. The solvent is preferred to be used in an amount of $10^{-3}$ to 1.0% by weight, more preferably $10^{-2}$ to $10^{-1}$% by weight, based on the reaction solution.

For example, the distribution of grain size becomes a state of monodispersed system and the rate of growth can be increased with increase of the amount of the solvent. On the other hand, the thickness of grains tends to increase with the increase of the amount of the solvent.

Examples of silver halide solvents which are frequently used include ammonia, thioethers and thioureas. Concerning thioethers, U.S. Pat. Nos. 3,271,157, 3,790,387 and 3,574,628, etc. can be referred to.

In production of the tabular silver halide grains of the present invention, in order to accelerate growth of grains, methods of increasing the rates of adding a silver salt solution (for example, an aqueous solution of $AgNO_3$) and a halide solution (for example, an aqueous solution of KBr), the amounts of them and the concentrations of them are suitably used.

Concerning these methods, for example, British Pat. No. 1,335,925, U.S. Pat. Nos. 3,672,900, 3,650,757 and 4,242,445, and Japanese Patent Application (OPI) Nos. 142329/80 and 158124/80 can be referred to.

The surface latent image type silver halide emulsions may contain grains having a regular crystal form such as a cube or octahedron, grains having an irregular crystal form such as a sphere, or grains having a composite crystal form of them, besides the above described tabular silver halide grains. These silver halide grains are preferred to have an average grain size larger than that of silver halide emulsions having fog nuclei in the inside. They preferably have an average grain size of 0.6 μm or more. The distribution of grain size may be broad or narrow.

Further, as silver halide, it is possible to use silver chloroiodide, silver iodobromide, silver chloride, silver chlorobromide, silver bromide and silver chloroiodobromide. Further, as the silver halide, those having a silver iodide content of 0 to 10% by mol, such as silver iodobromide, are particularly preferred.

Photographic emulsions containing these grains can be prepared by processes as described in P. Glafkides, *Chimie et Physique Photographique,* published by Paul Montel Co., (1967), G. F. Duffin, *Photographic Emulsion Chemistry,* published by The Focal Press, (1966), and V. L. Zelikman et al, *Making and Coating Photographic Emulsion,* published by The Focal Press, (1964), etc. Namely, any of an acidic process, a neutral process and an ammonia process may be used. Further, as a type of reacting soluble silver salts with soluble halides, any of a one-side mixing process, a simultaneous mixing process and a combination of them may be used.

It is possible to use a process of forming grains in the presence of excess silver ions (the so-called back mixing process). As a type of the simultaneous mixing process, it is possible to use a process of keeping pAg in the liquid phase where silver halide is formed at a constant value, namely, the so-called controlled double-jet process, too.

According to this process, silver halide emulsions having a regular crystal form and a nearly uniform grain size are obtained.

Two or more silver halide emulsions prepared respectively may be used as a mixture.

Formation of silver halide grains such as tabular silver halide grains used in the present invention or physical ageing of them may be carried out in the presence of cadmiun salts, zinc salts, lead salts, thallium salts, iridium salts or complex salts thereof, rhodium salts or complex salts thereof, or iron salts or iron complex salts, etc.

Soluble salts are generally removed from the light-sensitive silver halide emulsions used in the present invention after formation of precipitates or after physical ageing. As means for removal, it is possible to use a noodle water wash process well-known hitherto in which gelatin is gelatinized, or a flocculation process utilizing inorganic salts composed of polyvalent anions such as sodium sulfate, anionic surface active agents, anionic polymers (for example, polystyrenesulfonic acid) or gelatin derivatives (for example, aliphatic acylated gelatin, aromatic acylated gelatin, or aromatic carbamoyl gelatin, etc.). The process of removal of soluble salts may be omitted.

As the light-sensitive silver halide emulsions, the so-called primitive emulsions which are not chemically sensitized can be used, but they are generally chemically sensitized. In order to carry out chemical sensitization, it is possible to use processes as described in the above described literature written by Glafkides or Zelikman et al, and *Die Grundlagen der Photographischen Prozesse mit Silberhalogeniden,* edited by H. Frieser (Akademische Verlagsgesellshaft, 1968).

Namely, a sulfur sensitization process using a sulfur containing compound capable of reacting with silver ion, a reduction sensitization process using a reducing substance and a noble metal sensitization process using a gold or other noble metal compound can be used alone or as a combination of them. As sulfur sensitizers, thiosulfates, thioureas, thiazoles, rhodamines and other compounds can be used, examples of which have been described in U.S. Pat. Nos. 1,574,944, 2,410,689, 2,278,947, 2,728,668, 3,656,955, 4,032,928 and 4,067,740. As reducing sensitizers, stannous salts, amines, hydrazine derivatives, formamidine sulfinic acid, silane compounds, etc. can be used. Examples of them have been described in U.S. Pat. Nos. 2,487,850, 2,419,974, 2,518,698, 2,983,609, 2,983,610, 2,694,637, 3,930,867 and 4,054,458. In order to carry out noble metal sensitization, not only gold complex salts but also complex salts of metals of group VIII in the periodic table such as platinum, iridium or palladium, etc. can be used. Examples of them have been described in U.S. Pat. Nos. 2,399,083 and 2,448,060 and British Pat. No. 618,061, etc.

In the photographic light-sensitive materials of the present invention, various kinds of hydrophilic colloids can be used as a binder.

As colloids used for such a purpose, there are hydrophilic colloids conventionally used in the photographic field, for example, gelatin, colloidal albumin, polysaccharide, cellulose derivatives and synthetic resins such as polyvinyl compounds including polyvinyl alcohol derivatives, or acrylamide polymers, etc. Hydrophobic colloids, for example, dispersed polymerized vinyl compounds and, particularly, those which increase dimensional stability of photographic materials, may be contained together with the hydrophilic colloids. Suitable examples of such compounds include water insoluble polymers produced by polymerizing vinyl monomers such as alkyl acrylates, alkyl methacrylates, acrylic acid, sulfoalkyl acrylates, or sulfoalkyl methacrylates, etc.

In order to prevent deterioration of sensitivity in the process of producing the sensitive materials, during preservation or during treatment of the sensitive materials, various compounds can be added to the above described photographic emulsions. Examples of such compounds include heterocyclic compounds including 4-hydroxy-6-methyl-1,3,3a,7-tetrazaindene, 3-methylbenzothiazole and 1-phenyl-5-mercaptotetrazole, mercury containing compounds, mercapto compounds and metal salts, etc. Those compounds have been known hitherto.

Examples of some useful compounds include those as described in K. Mees, *The Theory of the Photographic Process* (3rd edition, 1966) with citing original literatures, and in U.S. Pat. Nos. 1,758,576, 2,110,178, 2,131,038, 2,173,628, 2,697,040, 2,304,962, 2,324,123, 2,394,198, 2,444,605 to 2,444,608, 2,566,245, 2,694,716, 2,697,099, 2,708,162, 2,728,663 to 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, and 3,622,339, and British Pat. Nos. 893,428, 403,789, 1,173,609 and 1,200,188, etc.

Further, as the silver halide emulsions having fog nuclei in the inside thereof used for producing the light-sensitive materials of the present invention, there are emulsions which give a transmission fog density (excluding the density of the support itself) of 0.5 or less when a test sample prepared by applying the emulsion to a transparent support so as to be 2 g/m$^2$ calculated as silver is developed with D-19 (a developing solution designated by Eastman Kodak Co.) at 35° C. for 2 minutes without exposing to light and gives a transmission fog density (excluding the density of the support itself) of 1.0 or more when the same test sample is developed with a developing solution prepared by adding 0.5 g/l of potassium iodide to D-19 at 35° C. for 2 minutes without exposing to light.

The silver halide emulsions having fog nuclei in the inside thereof can be prepared by various known processes. Processes for fogging include a process which comprises irradiating to light or X-rays, a process which comprises forming chemically fogged nuclei with a reducing agent, a gold compound or a sulfur containing compound, etc., and a process which comprises producing the emulsion under a condition of low pAg and high pH. In order to form fog nuclei in only the inside, there is a process which comprises bleaching fog nuclei on the surface of silver halide grains with a solution of potassium ferricyanide after both the inside and the surface of the grains are fogged by the above described processes, but it is preferred to use a process which comprises preparing a core emulsion having fog nuclei under a condition of low pAg and high pH or by chemically fogging, and thereafter covering the core emulsion with a shell emulsion. This process for preparing a core-shell emulsion is known and a description is present in, for example, U.S. Pat. No. 3,206,313.

Further, control of the depth of inside fog nuclei from the surface can be easily carried out by changing the conditions (for example, time, temperature and concentration of the solution, etc.) of bleaching the surface fog nuclei with a solution of potassium ferricyanide. Further, in the core-shell emulsions, the position of inside fog nuclei can be easily controlled by controlling the amount of the shell emulsion (namely, thickness).

Further, the inside fog nuclei of the inside fogged grains is preferred to be present in an average depth of 0.02 μm or more from the surface of the grains to prevent fogging and stains forming during fixation.

The silver halide emulsions having fog nuclei in the inside have an average grain size smaller than that of the surface latent image type silver halide emulsions, and they are preferred to have an average grain size of 0.05 to 1.0 μm, more preferably 0.1 to 0.6 μm, and particularly preferably 0.1 to 0.5 μm.

The grain size of silver halide grains which are not tabular or plate-like means the diameter of the grain in case that the grain is spherical or nearly spherical or the diameter of a grain having the same volume in case that the grain has another form (for example, cube or octahedron, etc.).

Further, in the inside fogged silver halide emulsion, any of silver bromide, silver iodobromide, silver iodochlorobromide, silver chlorobromide and silver chloride may be used.

The ratio of the light-sensitive silver halide to the inside fogged silver halide in the silver halide photographic light-sensitive materials of the present invention can be varied according to the kind of emulsions used (for example, compositions of halides), the kind of utility of the light-sensitive material used, or the contrast of the emulsions used, etc., but it is preferred to be in a range of 100:1 to 1:100 and particularly preferably, 10:1 to 1:10 Further, the amount of silver coated is preferred to be in a range of 0.5 to 8 g per $m^2$.

With respect to layer construction of the photographic materials according to the present invention, there are several embodiments. Typical embodiments are described in the following. There are (1) a construction which is prepared by applying a mixed emulsion composed of tabular silver halide grains of the present invention and inside fogged silver halide grains to a support and applying a protective layer to the resulting layer, (2) a construction which is prepared by applying first an emulsion containing inside fogged silver halide grains to a support applying an emulsion containing tabular silver halide grains of the present invention to the resulting layer and applying a protective layer to the resulting layer, (3) a construction which is prepared by applying first a mixed emulsion composed of tabular silver halide grains of the present invention and inside fogged silver halide grains to a support, applying an emulsion containing tabular silver halide grains of the present invention to the resulting layer, and applying a protective layer to the resulting layer, (4) a construction which is prepared by applying a mixed emulsion of tabular silver halide grains of the present invention, conventional light-sensitive silver halide grains and inside fogged silver halide grains of the present invention to a support, and applying a protective layer to the resulting layer, (5) a construction which is prepared by applying first a mixed emulsion composed of tabular silver halide grains of the present invention and inside fogged silver halide grains to a support, applying a conventional light-sensitive silver halide emulsion to the resulting layer, and applying a protective layer to the resulting layer, and (6) a construction which is prepared by applying first an emulsion containing inside fogged silver halide grains to a support, applying an emulsion containing tabular silver halide grains of the present invention to the resulting layer, applying an emulsion containing the conventional light-sensitive silver halide grains to the resulting layer, and applying a protective layer to the resulting layer.

However, the present invention is not limited to them, and the above described constructions may be provided on both sides of the support, and the silver halide emulsion layer may be separated into three or more emulsion layers each having a different distribution of spectral sensitivity.

When the light-sensitive materials of the present invention are developed in the presence of one or more selected from tetrazaindenes having at least one mercapto group, purines having at least one mercapto group, triazaindenes having at least one mercapto group and pentazaindenes having at least one mercapto group, prevention of fogs and prevention of irregular stains, etc. are effectively carried out. Examples, of these compounds include the following.

A

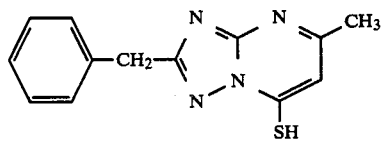

B

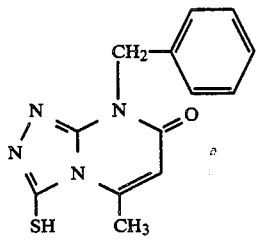

C

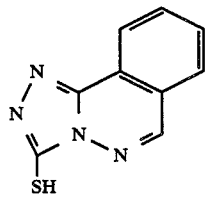

D

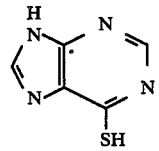

-continued

E

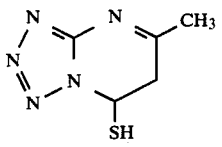

F

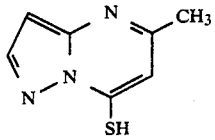

The amount of them to be added is preferred to be in a range of $1\times10^{-5}$ to $1\times10^{-1}$ mols/mol-silver halide and, preferably, $1\times10^{-4}$ to $1\times10^{-2}$ mols/mol-silver halide.

Further, development acceleration of the light-sensitive materials of the present invention can be carried out by adding a compound represented by the following general formula (I) to any of elements provided on the support:

$$A—S—S—B \qquad (I)$$

wherein A and B, which may be identical or different, each represents an alkyl group, an aralkyl group, an aryl group, a heterocyclic group, or

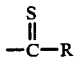

in which R represents an alkyl group, an aryl group, an aralkyl group, a heterocyclic group or an amino group. Examples of these compounds include:

I-1

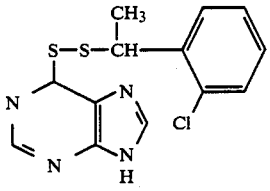

I-2

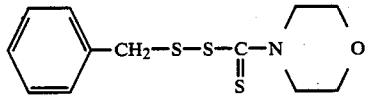

A protective layer of the silver halide photographic light-sensitive material of the present invention is a layer composed of a hydrophilic colloid. Those exemplified above can be used as the hydrophilic colloid used herein. The protective layer may be of single layer or multilayer structure.

To the emulsion layer or the protective layer of the silver halide photographic light-sensitive material of the present invention, and preferably to the protective layer, matting agents and/or smoothing agents may be added. Examples of the matting agents include organic compounds such as water dispersive vinyl polymers having a suitable grain size (those having a grain size of 0.3 to 5 μm or those having a grain size of two times or more, preferably four times or more, of the thickness of the protective layer are preferred to use) such as polymethyl methacrylate, etc. and inorganic compounds such as silver halides or strontium barium sulfate, etc. The smoothing agents not only serve for preventing troubles caused by adhesion, likewise the matting agents, but also are effective for improving friction characteristics which have relation to camera adaptability in case of photographing or projecting movie films. Examples of them include liquid paraffins, waxes such as higher fatty acid esters, etc., polyfluorinated hydrocarbons and derivatives thereof, and silicones such as polyalkyl polysiloxanes, polyaryl polysiloxanes, polyalkylaryl polysiloxanes or alkylene oxide addition derivatives of them, etc.

In the silver halide photographic light-sensitive material of the present invention, an antihalation layer, an intermediate layer and a filter layer, etc. may be provided as occasion demands.

In the light-sensitive material of the present invention, the photographic silver halide emulsion layers and other hydrophilic colloid layers can be hardened with suitable hardening agents. Examples of these hardening agents include vinyl sulfonyl compounds, hardening agents having an active halogen, dioxane derivatives and oxypolysaccharides such as oxystarch, etc., as described in Japanese Patent Application (OPI) Nos. 76025/78, 76026/78 and 77619/78.

To the photographic silver halide emulsion layers, it is possible to add other additives. Particularly useful additives for the photographic emulsions include lubricants, sensitizers, light absorbing dyes and plasticizers, etc.

Further, in the present invention, compounds which release iodine ion (for example, potassium iodide, etc.) may be contained in the silver halide emulsion, and desired images may be obtained with a developing solution containing iodine ions.

In the light-sensitive material of the present invention, the hydrophilic colloid layers may contain water soluble dyes as filter dyes or for the purpose of preventing irradiation, preventing halation or for other various purposes. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful.

In the light-sensitive material of the present invention, in case that dyes and ultraviolet ray absorbers, etc. are contained in the hydrophilic colloid layers, they may be mordanted with cationic polymers. For example, it is possible to use polymers as described in British Pat. No. 685,475, U.S. Pat. Nos. 2,675,316, 2,839,401, 2,882,156, 3,048,487, 3,184,309 and 3,445,231, German Offenlegungsschrift No. 1,914,362 and Japanese Patent Application (OPI) Nos. 47624/75 and 71332/75.

The light-sensitive material of the present invention may contain surface active agents for various purposes. Any of nonionic, ionic and ampholytic surface active agents can be used depending on the purpose. For example, there are polyoxyalkylene derivatives and amphoteric amino acids (including sulfobetaines), etc. Such surface active agents have been described in U.S. Pat. Nos. 2,600,831, 2,271,622, 2,271,623, 2,275,727, 2,787,604, 2,816,920 and 2,739,891 and Belgium Pat. No. 652,862.

In the light-sensitive material of the present invention, the photographic emulsions may be spectrally sensitized with sensitizing dyes so as to be sensitive to blue light having comparatively long wave lengths, green light, red light or infrared light. As the sensitizing dyes, it is possible to use cyanine dyes, merocyanine dyes, complex cyanine dyes, complex merocyanine dyes, holopolar cyanine dyes, styryl dyes, hemicyanine dyes, oxonol dyes and hemioxonol dyes, etc.

Useful sensitizing dyes used in the present invention have been described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese Patent Application (OPI) No. 76525/73 and Belgium Pat. No. 691,807, etc.

The sensitizing dyes in the present invention are used in the same concentration as conventional negative type silver halide emulsions. It is particularly advantageous to use them in a dye concentration so as not to substantially deteriorate inherent sensitivity of the silver halide emulsions. It is preferred to use the sensitizing dyes in a range of about $1.0\times10^{-5}$ to $5\times10^{-4}$ mols per mol of silver halide and, more preferably, about $4\times10^{-5}$ to $2\times10^{-4}$ mols per mol of silver halide.

In the photographic light-sensitive material of the present invention, the photographic emulsion layers and other layers are provided on one side or both sides of an elastic support conventionally used for photographic light-sensitive materials. Examples of useful elastic supports include films composed of synthetic polymers such as cellulose acetate, cellulose acetate butyrate or polyethylene terephthalate, and papers coated or laminated with a barita layer or a α-olefin polymer (for example, polyethylene, etc.).

In the photographic light-sensitive material of the present invention, the photographic emulsion layers and other hydrophilic colloid layers can be applied to the support or other layer by various known coating methods. Application can be carried out using a dip coating method, a roll coating method, a curtain coating method or an extrusion coating method, etc. Methods as described in U.S. Pat. Nos. 2,681,294, 2,761,791 and 3,526,528 are advantageous to use.

The present invention can be applied to any photographic light-sensitive material, if it requires a high sensitivity or a high contrast. For example, the present invention can be used for X-ray photographic light-sensitive materials, litho-type photographic light-sensitive materials, black-white negative photographic light-sensitive materials, color negative light-sensitive materials and color paper light-sensitive materials, etc.

Further, it is possible to use for diffusion transfer light-sensitive materials which form positive images by dissolving an unexposed silver halide to precipitate it on an image receiving layer adjacent to the silver halide emulsion layer, and color diffusion transfer light-sensitive materials, etc.

Photographic processing of the light-sensitive materials of the present invention can be carried out by known methods using known processing solutions as described in, for example, *Research Disclosure,* No. 176, pages 28–30 (RD-17643). This photographic processing may be any of photographic processing for forming silver images (black-white photographic processing) and photographic processing for forming dye images (color photographic processing) according to the purpose. The processing temperature is generally selected from a range of 18° C. to 50° C., but it may be lower than 18° C. or higher than 50° C.

For example, developing solution used in case of carrying out black-white photographic processing may contain known developing agents. As the developing agents, dihydroxybenzenes (for example, hydroquinone), 3-pyrazolidones (for example, 1-phenyl-3-pyrazolidone) and aminophenols (for example, N-methyl-p-aminophenol), etc. can be used alone or as a combination of them. The light-sensitive material of the present invention can be processed with a developing solution containing imidazoles as a silver halide solvent as described in Japanese Patent Application (OPI) No. 78535/82. Further, they can be processed with a developing solution containing a silver halide solvent and additives such as indazoles or triazoles, etc. as described in Japanese Patent Application (OPI) No. 37643/82. The developing solutions usually further contain known preservatives, alkali agents, pH buffer agents, and antifogging agents. If necessary, they may still further contain dissolution assistants, toning agents, development accelerators, surface active agents, defoaming agents, water softeners, hardening agents and thickeners, etc.

The photographic emulsions of the present invention can be subjected to the so-called "litho-type" development processing. "Litho-type" development processing means the development processing in which the development is infectiously carried out under a low sulfurous acid ion concentration using dihydroxybenzenes as a developing agent in order to obtain photographic reproduction of line drawings or photographic reproduction of halftone images with dots (as described in detail in Mason, *Photographic Processing Chemistry,* pages 163–165 (1966)).

As a specific type of development processing, it is possible to use a process which comprises developing a light-sensitive material containing a developing agent in, for example, an emulsion layer with an aqueous solution of alkali. Of the developing agents, hydrophobic developing agents can be introduced into the emulsion layers by various methods as described in *Research Disclosure,* No. 169 (RD-16928), U.S. Pat. No. 2,739,890, British Pat. No. 813,253 and German Pat. No. 1,547,763, etc. Such development processing may be combined with silver salt stabilization treatment using thiocyanates.

As fixing solutions, those having a conventionally used composition can be used. As fixing agents, not only thiosulfates and thiocyanates but also organic sulfur compounds which are known to have an effect as the fixing agent can be used. The fixing solutions may contain water soluble aluminum salts as a hardening agent.

EXAMPLE 1

(1) Preparation of spherical light-sensitive silver halide emulsion for comparison A spherical silver iodobromide emulsion (AgI: 2% by mol) having an average grain size of 1.3 μm was prepared from silver nitrate, potassium bromide and potassium iodide by a conventional ammonia process. The emulsion was desalted by a conventional precipitation process and chemically sensitized by a gold sulfur sensitization method using chloroaurate and sodium thiosulfate, and 4-hydroxy-6-methyl-1,3,3a,7-tetrazaindene as a stabilizer was added thereto to obtain a spherical light-sensitive silver iodobromide emulsion A for comparison.

(2) Preparation of tabular light-sensitive silver halide emulsion for comparison A tabular silver iodobromide emulsion (AgI: 2% by mol) having an average diameter of 1.3 μm and an average diameter/thickness ratio of 3.7 was prepared from silver nitrate, potassium bromide and potassium iodide using thioether ($HO(CH_2)_2S(CH_2)_2S(CH_2)_2OH$) with reference to U.S. Pat. Nos. 3,271,157, 3,790,387 and 3,574,628. The emulsion was desalted and chemically sensitized by the same manner as in (1) above, and 4-hydroxy-6-methyl-1,3,3a,7-tetrazaindene as a stabilizer was added thereto to obtain a tabular light-sensitive silver iodobromide emulsion B for comparison.

(3) Preparation of tabular light-sensitive halide emulsion of the present invention A tabular silver iodobromide emulsion (AgI: 2% by mol) having an average diameter of 1.63 μm and an average diameter/thickness ratio of 11.6 was prepared from silver nitrate, potassium bromide and potassium iodide by the same manner as in (2) above except that the amount of thioether ($HO(CH_2)_2S(CH_2)_2S(CH_2)_2OH$) was varied. The emulsion was desalted and chemically sensitized by the same manner as in (2) above, and 4-hydroxy-6-methyl-1,3,3a,7-tetrazaindene as a stabilizer was added thereto to obtain a tabular light-sensitive silver iodobromide emulsion C of the present invention.

(4) Preparation of inside fogged emulsion

An aqueous solution of potassium bromide and an aqueous solution of silver nitrate were added at the same time to a 2 wt% aqueous solution of gelatin kept at 55° C. to prepare silver bromide core grains having an average grain size of 0.326 μm. Subsequently, the temperature was raised to 75° C., and silver nitrate and sodium hydroxide were added thereto to carry out ageing for 15 minutes, whereby the surface of core grains was chemically fogged. The pH and pAg were then returned to the original values, and the temperature was reduced to 55° C. Subsequently, an aqueous solution of silver bromide and an aqueous solution of silver nitrate were added at the same time over such a period of time that the average grain size became 0.370 μm to deposit a shell on the fogged core grains. The resulting emulsion was desalted by a conventional precipitation process and dispersed again in a solution of gelatin to obtain an inside fogged emulsion D.

(5) Production of comparative samples 1 to 5

An emulsion layer composed of each of the light-sensitive silver halide emulsions A, B and C prepared in (1), (2) and (3) above and a protective layer composed of an aqueous solution of gelatin were uniformly applied in turn to a polyester support which had been subjected to undercoating treatment, to produce comparative samples 1, 3 and 5. In these cases, the coating silver amount of the light-sensitive silver halide emulsion was 1.7 g/m$^2$, the coating amount of gelatin in the protective layer was 1.3 g/m$^2$, and the coating amount of gelatin in the emulsion layer was 2.2 g/m$^2$.

Each of the light-sensitive silver halide emulsions A and B was then blended with the inside fogged emulsion D. A layer composed of the resulting mixed solution and a protective layer composed of an aqueous solution of gelatin were uniformly applied in turn to the same support to produce comparative samples 2 and 4. In these cases, the coating silver amount of the light-sensitive silver halide emulsions A and B was 1.7 g/m$^2$, the coating silver amount of the inside fogged emulsion D was 1.7 g/m$^2$, the coating amount of gelatin in the protective layer was 1.3 g/m$^2$, and the coating amount of gelatin in the emulsion layer was 2.2 g/m$^2$.

(6) Production of sample 6 of the present invention

An emulsion layer composed of a mixture of the light-sensitive silver halide emulsion C prepared in (3) above and the inside fogged emulsion D prepared in (4) above and a protective layer composed of an aqueous solution of gelatin were uniformly applied in turn to a polyester support which had been subjected to undercoating treatment to produce a sample 6 of the present invention. In this case, the coating silver amount of the light-sensitive silver halide emulsion C was 1.7 g/m$^2$, the coating silver amount of the inside fogged emulsion D was 1.7 g/m$^2$, the coating amount of gelatin in the protective layer was 1.3 g/m$^2$, and the coating amount of gelatin in the emulsion layer was 2.2 g/m$^2$.

(7)

After the comparative samples 1 to 5 and the sample 6 of the present invention as prepared above were exposed to light wedge, they were developed with a developing solution A having the following formulation at 20° C. for 4 minutes, followed by fixing, washing with water and drying. They were then subjected to sensitometry.

| Formulation of developing solution A | |
|---|---|
| 1-Phenyl-3-pyrazolidone | 0.5 g |
| Hydroquinone | 20.0 g |
| Disodium ethylenediaminetetraacetate | 2.0 g |
| Potassium sulfite | 60.0 g |
| Boric acid | 4.0 g |
| Potassium carbonate | 20.0 g |
| Sodium bromide | 20.0 g |
| Diethylene glycol | 30.0 g |
| Water to make | 1 l |
| NaOH to make pH | 1.0 |

The results are shown in Table 1.

TABLE 1

| Sample No. | Emulsion (coating silver amount: g/m$^2$) | Photographic Properties: Relative Sensitivity | Maximum Density | Gamma | Fog |
|---|---|---|---|---|---|
| 1 (Comparison) | Emulsion A (1.7) | 100 | 0.7 | 0.4 | 0.05 |
| 2 (Comparison) | Emulsion A + Emulsion D (1.7 + 1.7) | 100* | 0.9 | 0.4 | 0.05 |
| 3 (Comparison) | Emulsion B (1.7) | 100 | 0.8 | 0.5 | 0.05 |
| 4 (Comparison) | Emulsion B + Emulsion D (1.7 + 1.7) | 100** | 1.0 | 0.5 | 0.05 |
| 5 (Comparison) | Emulsion C | 100 | 1.0 | 0.8 | 0.05 |
| 6 (Invention) | Emulsion C + Emulsion D (1.7 + 1.7) | 160*** | 2.1 | 2.1 | 0.05 |

*based on the sensitivity of Sample 1 being 100
**based on the sensitivity of Sample 3 being 100
***based on the sensitivity of Sample 5 being 100

Table 1 clearly shows that with comparative samples 2 and 4 the maximum density only slightly increased with the conventional low temperature treatment as compared with comparative samples 1 and 3, and the effect of improving relative sensitivity and gamma cannot be observed. On the contrary, in sample 6 of the present invention, the relative sensitivity, the maximum density and the gamma were remarkably improved as compared with comparative sample 5. Namely, when tabular silver halide grains having a diameter of 5 times or more of the thickness are used as the light-sensitive silver halide emulsion, images which were excellent in sensitivity, maximum density and gamma can be obtained by the conventional low temperature treatment. This fact means that the development time can be shortened, because the desired effect can be obtained by development for a definite time.

EXAMPLE 2

After the comparative samples 1 to 5 and the sample 6 of the present invention prepared in Example 1 were exposed to light wedge, they were developed with a developing solution B having the following formulation at 35° C. for 25 seconds, followed by fixing, washing with water and drying. They were then subjected to sensitometry.

| Formulation of developing solution B | |
|---|---|
| Potassium hydroxide | 29.14 g |
| Glacial acetic acid | 10.96 g |
| Potassium sulfite | 44.20 g |
| Sodium bicarbonate | 7.50 g |
| Boric acid | 1.00 g |
| Diethylene glycol | 28.96 g |
| Ethylenediaminetetraacetic acid | 1.67 g |
| 5-Methylbenzotriazole | 0.06 g |
| 5-Nitroindazole | 0.25 g |
| Hydroquinone | 30.00 g |
| Potassium bromide | 14.00 g |
| 1-Phenyl-3-pyrazolidone | 1.50 g |
| Glutaraldehyde | 4.93 g |
| Sodium metabisulfite | 12.60 g |
| Water to make | 1 l |

The pH was adjusted to 10.25.

The results are shown in Table 2.

TABLE 2

| Sample No. | Emulsion (coating silver amount: g/m$^2$) | Photographic Properties: Relative Sensitivity | Maximum Density | Gamma | Fog |
|---|---|---|---|---|---|
| 1 (Comparison) | Emulsion A (1.7) | 100 | 0.8 | 0.4 | 0.05 |
| 2 (Comparison) | Emulsion A + Emulsion D (1.7 + 1.7) | 105* | 1.4 | 0.7 | 0.05 |
| 3 (Comparison) | Emulsion B (1.7) | 100 | 1.0 | 0.6 | 0.05 |
| 4 (Comparison) | Emulsion B + Emulsion D (1.7 + 1.7) | 105** | 1.6 | 1.1 | 0.05 |
| 5 (Comparison) | Emulsion C | 100 | 1.3 | 1.0 | 0.05 |
| 6 (Invention) | Emulsion C + Emulsion D (1.7 + 1.7) | 150*** | 2.8 | 2.3 | 0.05 |

*based on the sensitivity of Sample 1 being 100
**based on the sensitivity of Sample 3 being 100
***based on the sensitivity of Sample 5 being 100

Table 2 clearly shows that the sensitivity, the maximum density and the gamma in the comparative samples 2 and 4 were not sufficiently improved in the conventional high temperature rapid treatment, in comparison with the comparative samples 1 and 3. On the contrary, sample 6 of the present invention showed a sufficiently high sensitivity, a sufficiently high maximum density and a sufficiently high gamma as compared with the comparative sample 5. Thus the effect of the present invention is remarkable.

EXAMPLE 3

(1) Preparation of inside fogged emulsion containing mercaptotetrazaindene

An aqueous solution of potassium bromide and an aqueous solution of silver nitrate were added at the same time to a 2 wt% aqueous solution of gelatin kept at 55° C. to prepare silver bromide core grains having an average grain size of 0.290 μm. The temperature was raised to 75° C., and silver nitrate and sodium hydroxide were added thereto to carry out ageing for 15 minutes, whereby the surface of core grains was chemically fogged. Then, the pH and pAg were returned to the original values by adding acetic acid and potassium bromide, and the temperature was reduced at 55° C. Subsequently, an aqueous solution of silver bromide and an aqueous solution of silver nitrate were added at the same time over such a period of time that the average grain size became 0.370 μm to deposit a shell on the fogged core grains. The resulting emulsion was desalted by a conventional precipitation process and dispersed again in an aqueous solution of gelatin. Then, mercaptotetrazaindene compound A having the following formula was added in an amount of $1.7\times10^{-3}$ mols per mol of silver halide to obtain an inside fogged emulsion E.

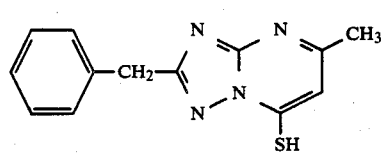

Compound A

(2) Production of comparative sample 7

An emulsion layer composed of the tabular light-sensitive silver halide emulsion C prepared in Example 1-(3) and a protective layer composed of an aqueous solution of gelatin were applied uniformly in turn to a polyester support which had been subjected to undercoating treatment to produce a comparative sample 7.

In this case, the coating silver amount of the emulsion C was 3.4 g/m$^2$, the coating amount of gelatin in the protective layer was 1.3 g/m$^2$, and the coating amount of gelatin in the emulsion layer was 2.2 g/m$^2$.

(3) Production of sample 8 of the present invention

An emulsion layer composed of a mixture of the tabular silver halide emulsion C prepared in Example 1-(3) and the inside fogged emulsion E prepared in (1) above and a protective layer composed of an aqueous solution of gelatin were uniformly applied to the same support in turn to produce a sample 8 of the present invention.

In this case, the coating silver amount of the emulsion C was 1.7 g/m$^2$, the coating silver amount of the emulsion E was 1.7 g/m$^2$, the coating amount of gelatin in the protective layer was 1.3 g/m$^2$m and the coating amount of gelatin in the emulsion layer was 2.2 g/m$^2$.

(4)

After the comparative sample 7 and the sample 8 of the present invention were exposed to light wedge, they were developed with the developing solution A as described in Example 1 at 20° C. for 4 minutes, followed by fixing, washing with water and drying. They were then subjected to sensitometry.

The results are shown in Table 3.

TABLE 3

| Sample No. | Emulsion (coating silver amount: g/m$^2$) | Photographic Properties | | | |
|---|---|---|---|---|---|
| | | Relative Sensitivity | Maximum Density | Gamma | Fog |
| 7 (Comparison) | Emulsion C (3.4) | 100 | 1.9 | 1.8 | 0.08 |
| 8 (Invention) | Emulsion C + Emulsion E (1.7 + 1.7) | 170 | 2.2 | 2.3 | 0.03 |

Table 3 clearly shows that the present invention is also effective when used in combination with compound A.

Example 4

(1) Production of comparative sample 9

An emulsion layer composed of a mixture of the spherical light-sensitive silver halide emulsion prepared in Example 1-(1) and the tabular light-sensitive silver halide emulsion C prepared in Example 1-(3) and a protective layer composed of an aqueous solution of gelatin were uniformly applied in turn to a polyester support which had been subjected to undercoating treatment to produce a comparative sample 9. In this case, the coating silver amount of the emulsion A was 0.85 g/m$^2$, the coating silver amount of the emulsion C was 0.85 g/m$^2$, the coating amount of gelatin in the protective layer was 1.3 g/m$^2$, and the coating amount of gelatin in the emulsion layer was 2.2 g/m$^2$.

(2) Production of samples 10, 11 and 12 of the present invention

An emulsion layer composed on only the inside fogged emulsion D prepared in Example 1-(4), an emulsion layer composed of only the tabular light-sensitive silver halide emulsion C prepared in Example 1-(3) and a protective layer composed of an aqueous solution of gelatin were uniformly applied in turn to a polyester support which had been subjected to undercoating treatment to produce a sample 10 having three layers of the present invention. In this case, the coating silver amount of the emulsion D in the lower emulsion layer was 1.7 g/m$^2$, the coating silver amount of the emulsion C in the upper emulsion layer was 1.7 g/m$^2$, the coating amount of gelatin in the protective layer was 1.3 g/m$^2$, the coating amount of gelatin in the upper emulsion layer was 1.1 g/m$^2$, and the coating amount of gelatin in the lower emulsion layer was 1.1 g/m$^2$.

Then, an emulsion layer composed of a mixture of the tabular light-sensitive silver halide emulsion C prepared in Example 1-(3) and the inside fogged emulsion D prepared in Example 1-(4), an emulsion layer composed of only the tabular light-sensitive silver halide emulsion C prepared in Example 1-(3) and a protective layer composed of an aqueous solution of gelatin were uniformly applied to the same support in turn to produce a sample 11 of the present invention. In this case, the coating silver amount of the emulsion C in the lower emulsion layer was 0.85 g/m$^2$, the coating silver amount of the emulsion D in the lower emulsion layer was 1.7 g/m$^2$, the coating silver amount of the emulsion C in the upper emulsion layer was 0.85 g/m$^2$, the coating amount of gelatin in the protective layer was 1.3 g/m$^2$, the coating amount of gelatin in the upper emulsion layer was 0.55 g/m$^2$, and the coating amount of gelatin in the lower emulsion layer was 1.65 g/m$^2$.

Further, an emulsion layer composed of a mixture of the spherical light-sensitive silver halide emulsion A prepared in Example 1-(1), the spherical light-sensitive silver halide emulsion C prepared in Example 1-(3) and the inside fogged emulsion D prepared in Example 1-(4) and a protective layer composed of an aqueous solution of gelatin were uniformly applied to the same support in turn to produce a sample 12 of the present invention. In this case, the coating silver amount of the emulsion A was 0.85 g/m$^2$, the coating silver amount of the emulsion C was 0.85 g/m$^2$, the coating silver amount of the emulsion D was 1.7 g/m$^2$, the coating amount of gelatin in the protective layer was 1.3 g/m$^2$, and the coating amount of the gelatin in the emulsion layer was 2.2 g/m$^2$.

(3)

After the comparative sample 5 prepared in Example 1, the above described comparative sample 9 and the samples 10 to 12 of the present invention were exposed to light wedge, they were developed with the developing solution A as described in Example 1 at 20° C. for 4 minutes, followed by fixing, washing with water and drying. Then, they were subjected to sensitometry.

The results are shown in Table 4.

TABLE 4

| Sample No. | Emulsion (coating silver amount: g/m$^2$) | Photographic Properties | | | |
|---|---|---|---|---|---|
| | | Relative Sensitivity | Maximum Density | Gamma | Fog |
| 5 (Comparison) | Emulsion C (1.7) | 100 | 1.0 | 0.8 | 0.05 |
| 10 (Invention) | Upper layer: Emulsion C (1.7) Lower layer: Emulsion D (1.7) | 160* | 2.1 | 2.0 | 0.05 |
| 11 (Invention) | Upper layer: Emulsion C (0.85) Lower layer: Emulsion C + Emulsion D (0.85 + 1.7) | 160* | 2.1 | 2.1 | 0.05 |
| 9 (Comparison) | Emulsion A + Emulsion C (0.85 + 0.85) | 100 | 0.85 | 0.6 | 0.05 |
| 12 (Invention) | Emulsion A + Emulsion C + Emulsion D (0.85 + 0.85 + 1.7) | 150** | 1.9 | 1.9 | 0.05 |

*based on the sensitivity of Sample 5 being 100
**based on the sensitivity of Sample 9 being 100

Table 4 clearly shows that the present invention is effective even if the emulsion layer has a multilayer construction. Further, it is understood that the present invention is effective even if tabular silver halide grains are used together with spherical silver halide grains.

While the invention has been described in detail and with reference to specific embodiments thereof, it will be apparent to one skilled in the art that various changes and modifications can be made therein without departing from the spirit and scope thereof.

What is claimed is:

1. A negative silver halide photographic light-sensitive material comprising a support having provided thereon at least one silver halide emulsion layer and a surface protective layer covering the silver halide emulsion layer, wherein the silver halide emulsion layer includes a light-sensitive surface latent image silver halide emulsion and an inside fogged silver halide emulsion, the inside fogged silver halide emulsion having a smaller average grain size than that of the surface latent image silver halide emulsion and the surface latent image silver halide emulsion containing tabular silver bromide or silver iodobromide grains having a silver iodide content of 0 to 10 mol% and a grain diameter which is 5 times or more the grain thickness.

2. A silver halide photographic light-sensitive material as claimed in claim 1, wherein the tabular silver halide grains are present in the light-sensitive silver halide emulsion in an amount of 10% by weight or more based on the weight of all the silver halide grains.

3. A silver halide photographic light-sensitive material as claimed in claim 2, wherein the tabular silver halide grains are present in the light-sensitive silver halide emulsion in an amount of 50% by weight or more based on the weight of all the silver halide grains.

4. A silver halide photographic light-sensitive material as claimed in claim 1, wherein the tabular silver halide grains have a grain diameter which is 5 to 100 times the grain thickness.

5. A silver halide photographic light-sensitive material as claimed in claim 4, wherein the tabular silver halide grains have a grain diameter which is 5 to 50 times the grain thickness.

6. A silver halide photographic light-sensitive material as claimed in claim 5, wherein the tabular silver halide grains have a grain diameter which is 7 to 20 times the grain thickness.

7. A silver halide photographic light-sensitive material as claimed in claim 1, wherein the tabular silver halide grains have a diameter of 0.5 to 10 μm.

8. A silver halide photographic light-sensitive material as claimed in claim 7, wherein the tabular silver halide grains have a diameter in the range of 0.5 to 5.0 μm.

9. A silver halide photographic light-sensitive material as claimed in claim 8, wherein the tabular silver halide grains have a diameter in the range of 1.0 to 4.0 μm.

10. A silver halide photographic light-sensitive material as claimed in claim 1, wherein the inside fogged silver halide emulsion has an average grain size of 0.05 to 1.0 μm.

11. A silver halide photographic light-sensitive material as claimed in claim 10, wherein the inside fogged silver halide emulsion has an average grain size of 0.1 to 0.6 μm.

12. A silver halide photographic light-sensitive material as claimed in claim 11, wherein the inside fogged silver halide emulsion has an average grain size in the range of 0.1 to 0.5 μm.

13. A silver halide photographic light-sensitive material as claimed in claim 1, wherein the ratio of the surface latent image light-sensitive silver halide to the inside fogged silver halide is in the range of 100:1 to 1:100.

14. A silver halide photographic light-sensitive material as claimed in claim 13, wherein the ratio of the surface latent image light-sensitive silver halide to the inside fogged silver halide is in the range of 10:1 to 1:10.

15. A silver halide photographic light-sensitive material as claimed in claim 1, wherein the silver is coated on the support in an amount in the range of 0.5 to 8 $g/m^2$.

16. The silver halide photographic light-sensitive material as claimed in claim 1, wherein the surface latent image light-sensitive silver halide emulsion has a sensitivity of 10 or more times that of the inside fogged silver halide emulsion.

17. The silver halide photographic light-sensitive material as claimed in claim 1, wherein the surface latent image light-sensitive silver halide emulsion as a sensitivity of 100 or more times that of the inside fogged silver halide emulsion.

18. A process for forming an image, comprising imagewise exposing and developing a silver halide light-sensitive material as claimed in claim 1, thereby obtaining a negative silver image.

* * * * *